US010850956B1

(12) United States Patent
Bertrand et al.

(10) Patent No.: US 10,850,956 B1
(45) Date of Patent: Dec. 1, 2020

(54) HAND HELD DEVICE

(71) Applicants: Bryant William Bertrand, Whittier, CA (US); Marc Gonfiotti, Whittier, CA (US)

(72) Inventors: Bryant William Bertrand, Whittier, CA (US); Marc Gonfiotti, Whittier, CA (US)

( * ) Notice: Subject to any disclaimer, the term of this patent is extended or adjusted under 35 U.S.C. 154(b) by 0 days.

(21) Appl. No.: 16/843,241

(22) Filed: Apr. 8, 2020

Related U.S. Application Data

(63) Continuation-in-part of application No. 15/678,998, filed on Aug. 16, 2017, now abandoned, which is a continuation-in-part of application No. 15/176,373, filed on Jun. 8, 2016, now abandoned.

(60) Provisional application No. 62/173,669, filed on Jun. 10, 2015.

(51) Int. Cl.
*B66D 1/74* (2006.01)
*B66D 5/16* (2006.01)

(52) U.S. Cl.
CPC ..... *B66D 1/7489* (2013.01); *B66D 1/7447* (2013.01); *B66D 5/16* (2013.01)

(58) Field of Classification Search
CPC ..... A62B 1/10; A62B 1/14; B66D 1/7426; B66D 1/7473; B66D 1/7484; B66D 1/7489; B66D 5/16; B66D 1/7421; B66D 1/7442; B66D 1/7447
See application file for complete search history.

(56) References Cited

U.S. PATENT DOCUMENTS

| | | | | |
|---|---|---|---|---|
| 3,797,608 | A * | 3/1974 | Virdis | E04G 3/32 182/112 |
| 3,980,161 | A * | 9/1976 | Mauldin | B61H 9/02 188/188 |
| 7,055,653 | B2 * | 6/2006 | Hamada | A62B 1/14 182/193 |
| 2006/0273293 | A1 * | 12/2006 | Ball | B66D 1/7447 254/371 |
| 2007/0194290 | A1 * | 8/2007 | Fofonoff | B66D 1/7415 254/325 |
| 2017/0050055 | A1 * | 2/2017 | Spydell, Jr. | A62B 1/14 |
| 2018/0296861 | A1 * | 10/2018 | Rogge | B66D 5/04 |

* cited by examiner

*Primary Examiner* — Sang K Kim
*Assistant Examiner* — Nathaniel L Adams
(74) *Attorney, Agent, or Firm* — Plager Schack LLP; Mark H. Plager; Michael J. O'Brien

(57) ABSTRACT

A handheld device is adapted to ascend and descend a cable. The handheld device includes a motor that is mechanically coupled to a gearbox shaft. A drive shaft is connected to the gearbox shaft with shaft drive bearings. A first housing is mechanically coupled to the motor and surrounding the drive shaft. The housing further includes a top side, a bottom side and at least one other side therebetween. A top housing opening and a side housing opening are arranged on the first housing. A cinch brake assembly, connected to the first housing. The cable is fed through the first housing, around the drive shaft, out of the first housing and through the cinch brake assembly such that the cinch brake assembly prevents movement of the cable through the first housing.

8 Claims, 5 Drawing Sheets

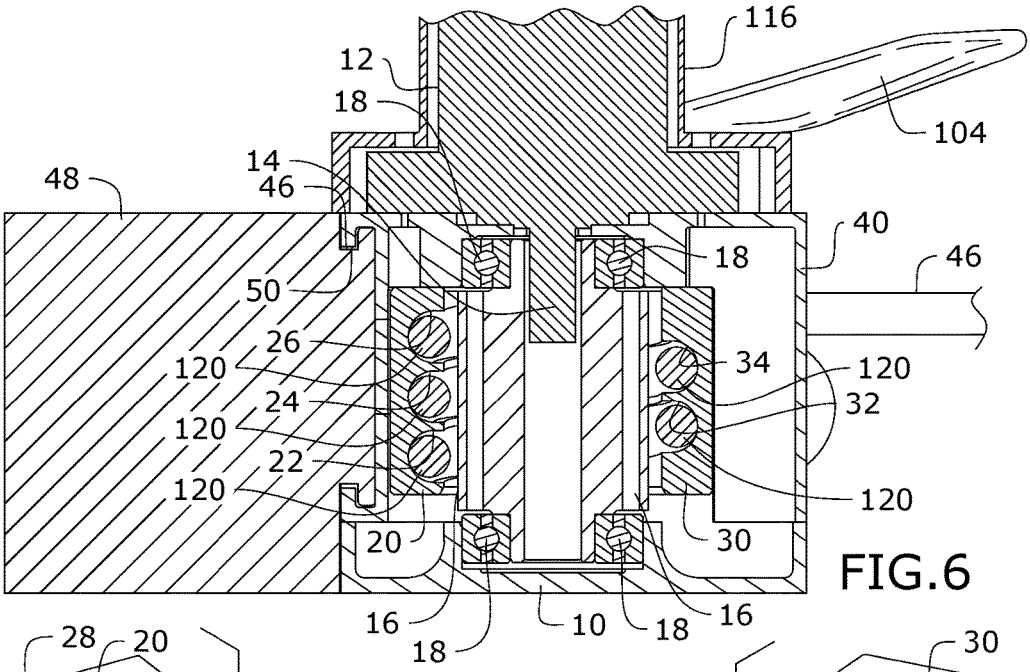
FIG.6
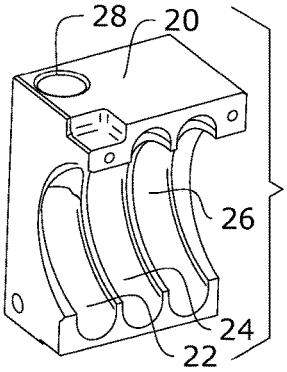
FIG.7
FIG.8
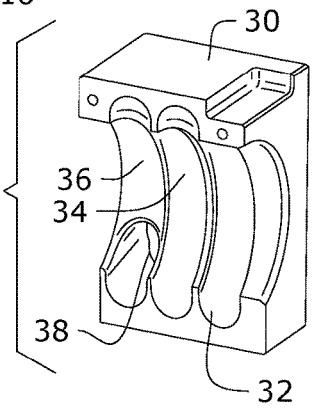
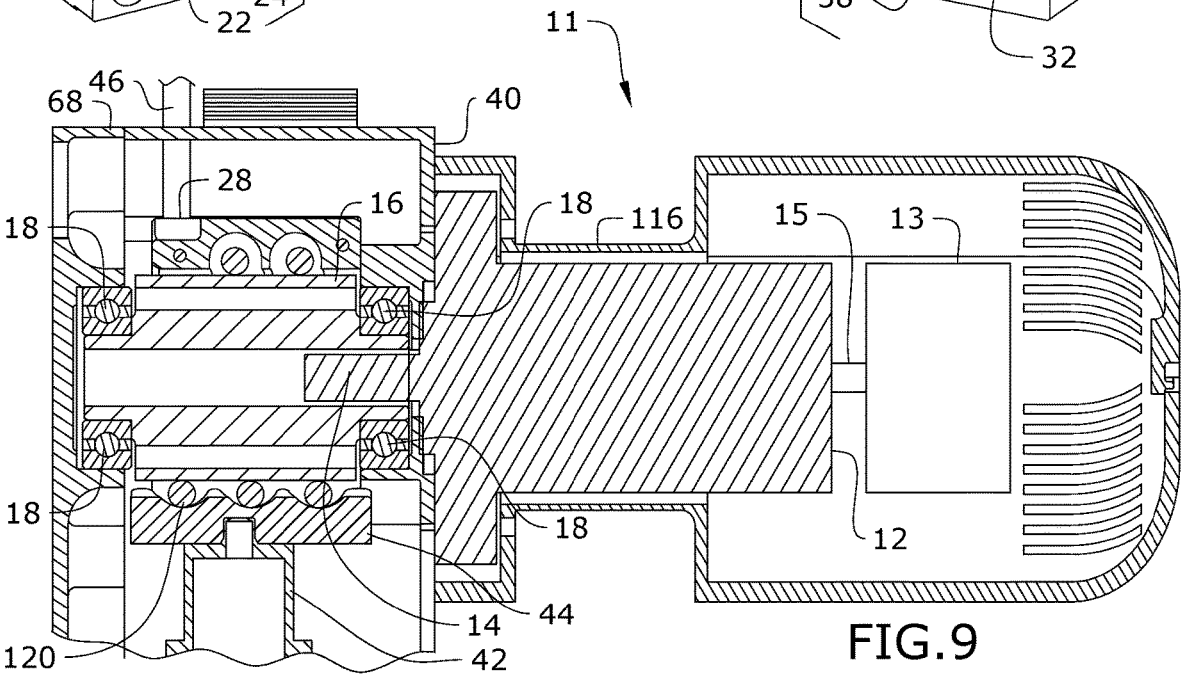
FIG.9

HAND HELD DEVICE

RELATED APPLICATION

This application is a continuation-in-part of non-provisional patent application U.S. Ser. No. 15/678,998 filed on Aug. 16, 2017 ("the '998 application").

The '998 application is a continuation-in-part of non-provisional patent application U.S. Ser. No. 15/176,373 filed on Jun. 8, 2016 ("the '373 application").

The '373 application claims priority to provisional patent application U.S. Ser. No. 62/173,669 filed on Jun. 10, 2015 ("the '669 application").

The entire contents of the '998 application, the '373 application, and the '669 application are herein incorporated by reference.

BACKGROUND

Many applications and markets require the ability to ascend and descend people and or objects quickly and safely. Traditionally this has been accomplished through a fixed hoist/winch mounted vertically above the said user or object. The mounted fixed position devices currently in the market limit a user's ability to easily transport and or change the fixed position of an ascent or descent. Transporting these devices for use is costly and time-consuming, further limiting the range of uses and applications. Embodiments of the disclosed invention solve these problems.

SUMMARY

A handheld device is adapted to ascend and descend a cable. The handheld device includes a motor that is operably connected to a gearbox shaft. A drive shaft is connected to the gearbox shaft with shaft drive bearings. A first housing is mechanically coupled to the motor and surrounding the drive shaft. The housing further includes a top side, a bottom side and at least one other side therebetween. A top housing opening and a side housing opening are arranged on the first housing. A cinch brake assembly, connected to the first housing. The cable is fed through the first housing, around the drive shaft, out of the first housing and through the cinch brake assembly such that the cinch brake assembly prevents movement of the cable through the first housing.

BRIEF DESCRIPTION OF THE FIGURES

The detailed description of some embodiments of the invention is made below with reference to the accompanying figures, wherein like numerals represent corresponding parts of the figures.

FIG. 6 shows a section view of one embodiment of the present invention taken along line 6-6 in FIG. 1;

FIG. 7 shows a perspective detail view of one component of one embodiment of the present invention;

FIG. 8 shows a perspective detail view of one component of one embodiment of the present invention;

FIG. 9 shows a section view of one embodiment of the present invention taken along line 9-9 in FIG. 1;

DETAILED DESCRIPTION OF CERTAIN EMBODIMENTS

Figure 1:
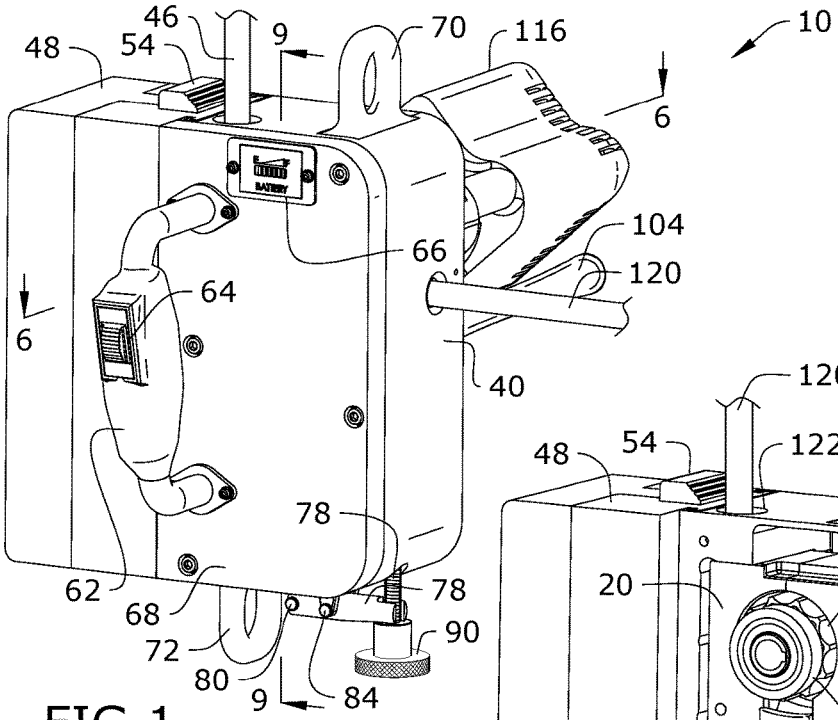
FIG. 1 shows a perspective view of one embodiment of the present invention.
Figure 2:
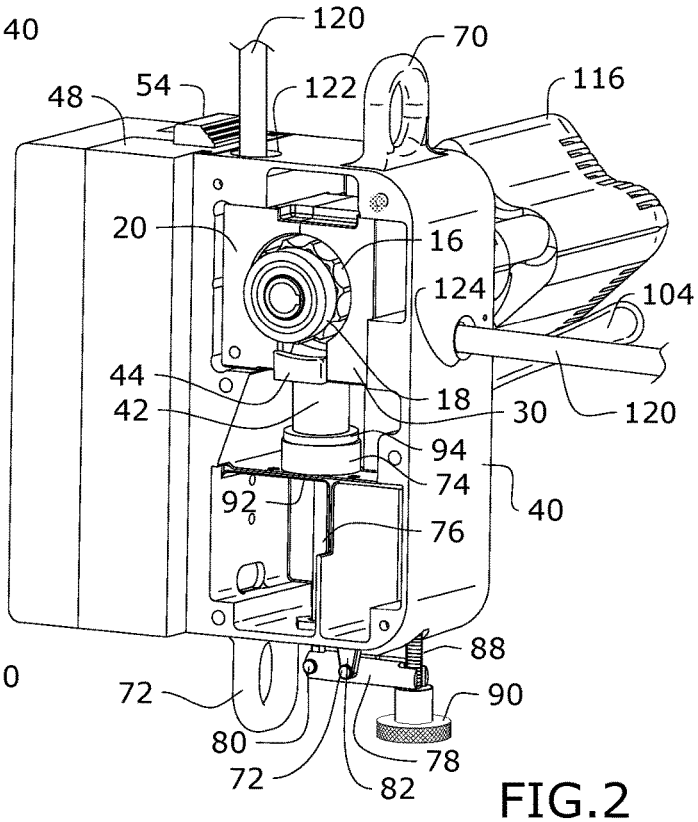
FIG. 2 shows a perspective view of one embodiment of the present invention omitting some components for illustrative clarity.
Figure 3:
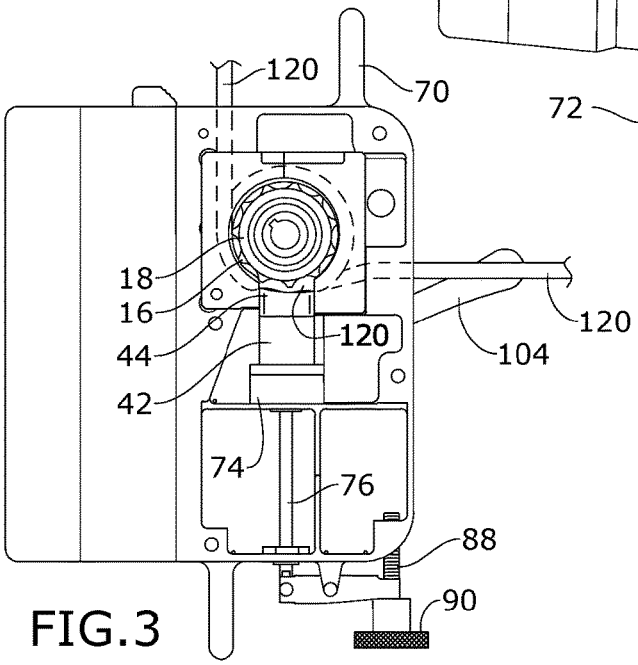
FIG. 3 shows a front view of one embodiment of the present invention omitting some components for illustrative clarity.
Figure 4:
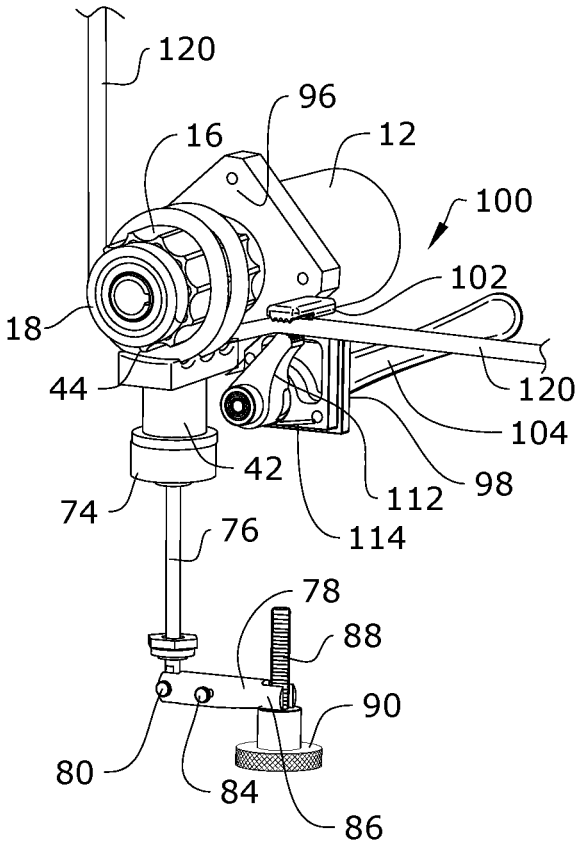
FIG. 4 shows a perspective view of one embodiment of the present invention omitting some components for illustrative clarity.
Figure 5:
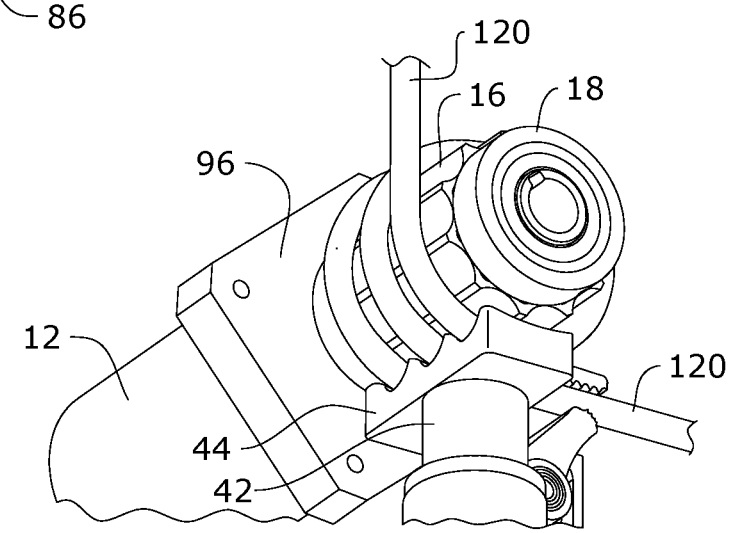
FIG. 5 shows a perspective view of one embodiment of the present invention omitting some components for illustrative clarity.
Figure 10:
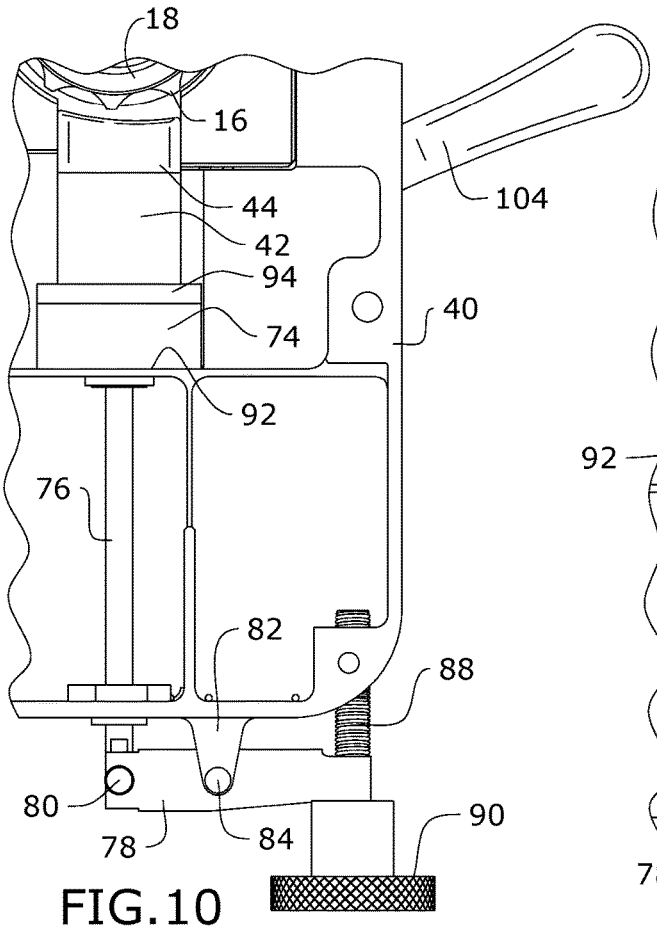
FIG. 10 shows a perspective view of one embodiment of the present invention omitting some components for illustrative clarity.
Figure 11:
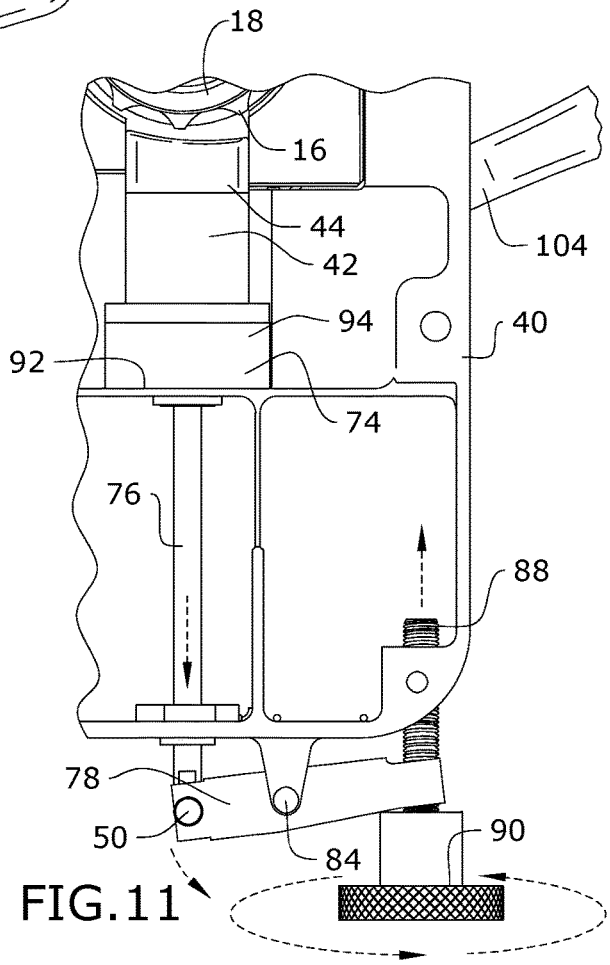
FIG. 11 shows a perspective view of one embodiment of the present invention omitting some components for illustrative clarity.
Figure 12:
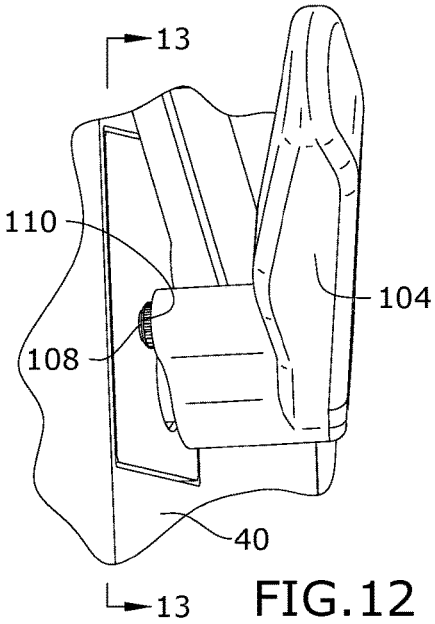
FIG. 12 shows a perspective view of one embodiment of the present invention.
Figure 13:
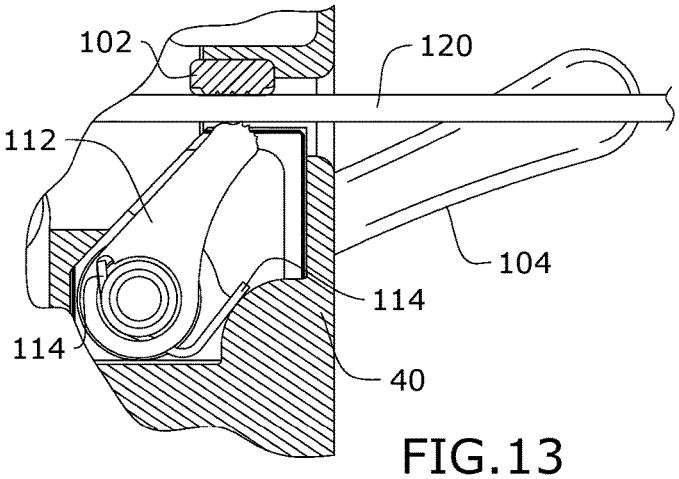
FIG. 13 shows a section view of one embodiment of the present invention taken along line 12-12 in FIG. 12.
Figure 14:
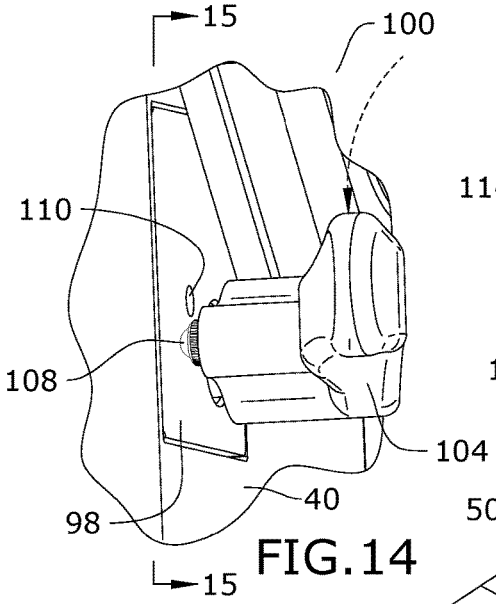
FIG. 14 shows a perspective view of one embodiment of the present invention.
Figure 15:
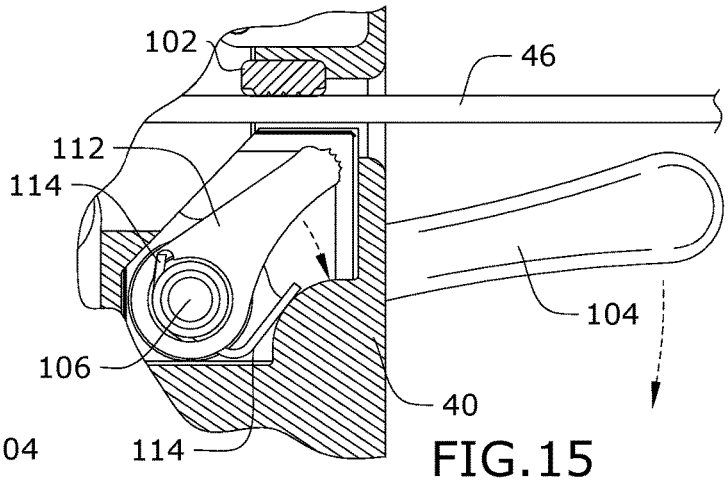
FIG. 15 shows a section view of one embodiment of the present invention taken along line 15-15 in FIG. 14.
Figure 16:
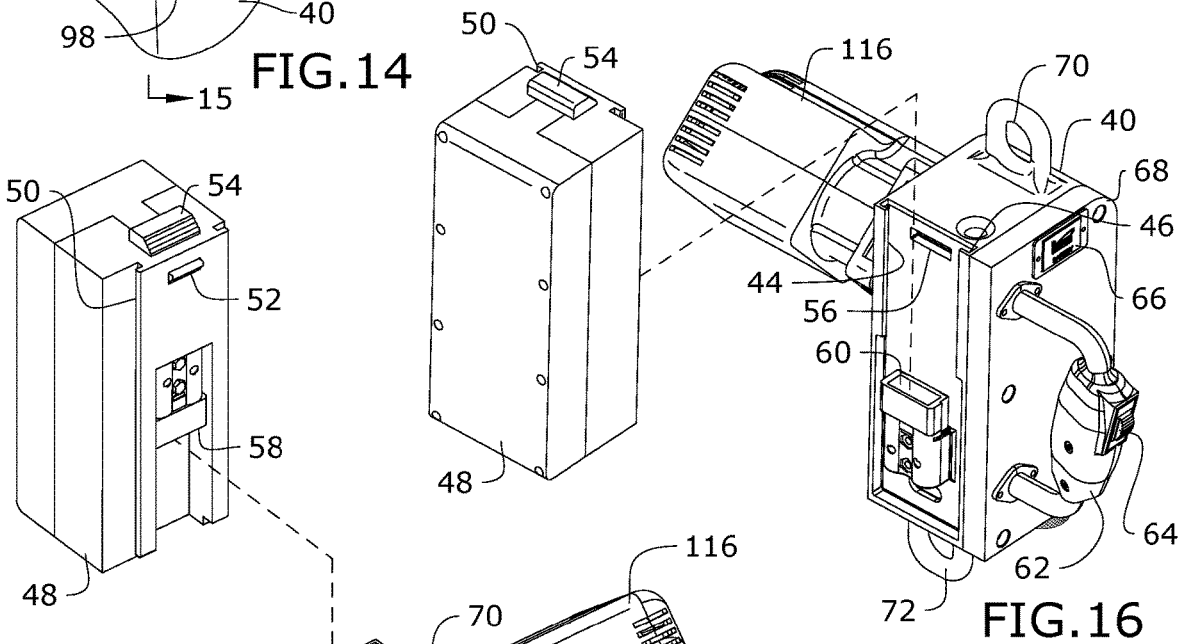
FIG. 16 shows an exploded view of one embodiment of the present invention.
Figure 17:
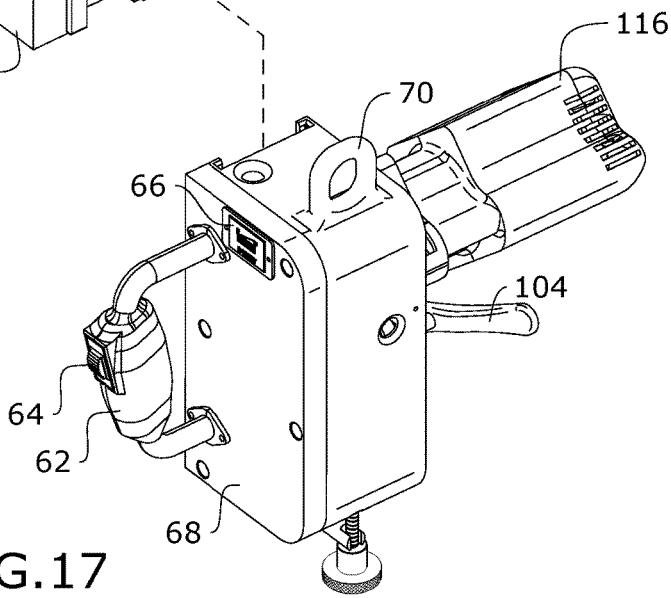
FIG. 17 shows an exploded view of one embodiment of the present invention.

By way of example, and referring to FIGS. 1-17, one embodiment of a handheld device 10 comprises a motor assembly 11. The motor assembly 11 further comprises a gearbox 12. The gearbox 12 is joined to a motor 13 with a motor shaft 15. The gearbox 12 is mechanically coupled to a gearbox shaft 14. The gearbox shaft 14 is connected to a drive shaft 16 with shaft drive bearings 18. The drive shaft 16 further comprises a paddles which enable a sprocket-like feature around the drive shaft 16.

The drive shaft 16 is partially surrounded by a first helical shaft block 20. The first helical shaft block 20 further comprises a first helical shaft block first shaft 22, a first helical shaft block second shaft 24, and a first helical shaft block third shaft 26. The first helical shaft block first shaft 22 is joined to a cable entry point 28 that is through a surface of the first helical shaft block 20.

The drive shaft 16 is partially surrounded by a second helical shaft block 30. The second helical shaft block 30 further comprises a second helical shaft block first shaft 32, a second helical shaft block second shaft 34, and a second helical shaft block third shaft 36. The second helical shaft block third shaft 36 is joined to a cable exit point 38 that is through a surface of the second helical shaft block 30.

The first helical shaft block 20 and the second helical shaft block 30 are connected to a first casing 40. The first casing 40 is proximate a tensioner 42 connected to a tension bracket 44. The first casing 40 further comprises a first casing rail 46. The tensioner can be a pinch tensioner linkage mechanism that pushes the cable 120 to the drive shaft 16.

A battery 48 further comprises a battery rail 50. The battery rail 50 mates with the first casing rail 46 to detachably couple the battery 48 to the first casing 40. The battery 48 further comprises a battery release button clip 52 that is attached to a battery unlock button 54 on a top surface of the battery 48. The first casing 40 further comprises a first casing slot receiver 56 that is adapted to receive the battery release button clip 52. The battery 48 further comprises a battery casing connector 58 which is adapted to mate with a first casing battery connector 60 on the first casing 40. In some embodiments, the battery 48 can be a 28 VDC lithium ion rechargeable battery. This kind of battery would have a battery life ascent of 3.5 minutes of continuous use of a 400-pound load or 7.0 minutes of continuous use under a 200-pound load.

The first casing 40 is mechanically coupled to a handle 62 which is, in turn, mechanically coupled to a thumbwheel switch 64. The first casing 40 is further mechanically coupled to a battery indicator 66. The battery 48 is electrically coupled to the gearbox 12 with the switch 64. The motor 13 is connected to a speed controller which controls the brushless DC motor with pulse width modulation. The thumbwheel switch 64 is also connected to the speed controller for variable speed control. The speed controller programming only allows the motor to spin in one direction (counterclockwise) allowing the user to ascend on a cable 120.

In some embodiments, the first casing 40 is detachably coupled to a first casing cover 68. The first casing cover 68 can be removed to access equipment within the first casing 40. A top side of the first casing 40 can be mechanically coupled to an upper body ring 70. A bottom side of the first casing 40 can be mechanically coupled to a lower body ring 72.

The tension bracket 44 is joined to a tension spring 74. The tension spring 74 is mechanically coupled to a shaft release 76. The shaft release 76 is detachably coupled to a lever link 78 with a shaft release pivot 80. The first casing 40 is attached to a pivot attachment extension 82. The pivot attachment extension 82 is attached to the lever link 78 with a lever link pivot 84. The lever link 78 further comprises a fork 86. The fork 86 has slot arms to allow the fork 86 to be moved up and down by the threaded knob 90. The first casing 40 has a threaded locking insert installed, the threaded shaft 88 screws in and out of the first casing 40 to apply or remove tension. The threaded shaft 88 is attached to a threaded knob 90. The tension spring 74 rests upon a housing wall 92. The tension spring 74 is joined to a shaft tensioner 94.

The gearbox 12 further comprises a flange 96 which is attached to the first casing 40. The flange 96 is immediately adjacent to a brake mounting plate 98. The brake mounting plate 98 is attached to a cinch brake assembly 100. The cinch brake assembly 100 further comprises a cinch brake shaft 106 that protrudes out both sides of a cinch arm 112. One side of the cinch arm 112 has a bearing installed and the opposite side has a slot for the cinch torsion spring 114 to be installed in. The bearing is then pressed onto the shaft capturing the cinch torsion spring 114. The cinch brake assembly 100 is installed into the first casing 40 and a brake mounting plate 98 is installed. The brake lever 104 further comprises a ball detent 110 installed in it and that assembly is installed on the cinch brake shaft 106. The cinch brake shaft 106 transmits torque through the brake lever 104 and to a toothed pivot cinch arm 112 via a keyed slot. The cinch brake shaft 106 is held onto the brake lever 104 by a locking screw. The brake lever 104 rotates allowing the ball detent 110 to pivot into a slot in the brake mounting plate 98 preventing the brake lever 104 from moving.

The gearbox 12 is surrounded by a motor casing 116. The motor casing 116 is attached to the gearbox 12 and the motor mounting plate 96. The first housing 40 is perforated with an upper housing opening 122 and a side housing opening 124. A cable 120 can be fed through the upper housing opening 122 into the cable entry point 28 and around the first helical block first shaft 22. From there, the cable 120 over the travels over the tensioner 42 and into the second helical shaft block first shaft 32. The cable 120 then travels into the first helical block second shaft 24 and passes into the second helical shaft block second shaft 34. The cable 120 continues over the tensioner 42 and into the first helical shaft block third shaft 26. The cable 120 then passes over the tensioner 42 into the second helical shaft block third shaft 36. From there, the line passes through the cable exit point 38 and out of the side housing opening 124. In some embodiments, the cable 120 can be a 9-11.7 mm aramid sheath static line rope.

When the cable 120 is under tension, the cable 120 is wrapped around the paddles arranged around the drive shaft 16. As shown in the figures this manipulates the rope into an 11-sided polygon or a hendecagon.

The handheld device 10 should be built to comply with ANSI/ASSE Z359.4-2013 standards, which are incorporated by reference in their entirety.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 116. In particular, any use of "step of" in the claims is not intended to invoke the provision of 35 U.S.C. § 112, 116.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A handheld device, adapted to ascend and descend a cable, the handheld device comprising:

a motor, mechanically coupled to a gearbox shaft;

a drive shaft, connected to the gearbox shaft with shaft drive bearings; wherein the drive shaft further comprises a plurality of paddles;

a first housing, mechanically coupled to a gearbox and surrounding the drive shaft;

wherein the first housing further comprises a top side, a bottom side and at least one other side therebetween;

a top housing opening and a side housing opening, arranged on the first housing;

a cinch brake assembly, connected to the first housing;

a first helical shaft block, partially surrounding the drive shaft; wherein the first helical shaft block further comprises a first helical shaft block first shaft, a first helical shaft block second shaft and a first helical shaft block third shaft; wherein the first helical shaft block first shaft is joined to a cable entry point that is through a first surface of the first helical shaft block;

a second helical shaft block, partially surrounding the drive shaft; wherein the second helical shaft block further comprises a second helical shaft block first shaft, a second helical shaft block second shaft and a second helical shaft block third shaft; wherein the second helical shaft block third shaft is joined to a cable exit point that is through a second surface of the second helical shaft block wherein the cable is fed through the first housing, around the drive shaft, out of the first housing and through the cinch brake assembly such that the cinch brake assembly prevents movement of the cable through the first housing.

2. The handheld device of claim 1, further comprising:

a first casing connected to the first helical shaft block and the second helical shaft block;

a first casing rail, arranged on the first casing;

a battery further comprises a battery rail; wherein the battery rail mates with the first casing rail to detachably couple the battery to the first casing.

3. The handheld device of claim 2, wherein the battery further comprises a battery release button clip that is attached to a battery release button on a battery top surface; and wherein the first casing further comprises a first casing slot receiver that is adapted to receive the battery release button clip.

4. The handheld device of claim 3, wherein the battery further comprises a battery casing connector which is adapted to mate with a first casing battery connector on the first casing.

5. The handheld device of claim 1, further comprises a tensioner connected to a tension bracket that is arranged within a first casing.

6. The handheld device of claim 5, further comprising:

a tension spring, joined to the tension bracket and a shaft release;

a lever link, detachably coupled to the shaft release with a shaft release pivot a pivot attachment extension, attached to the first casing;

a lever link pivot, connecting the pivot attachment extension and the lever link;

a fork, arranged on the lever link and connected to a threaded shaft with an upper flange and a lower flanges that capture the fork on the lever link.

7. The handheld device of claim 1, wherein a drive system comprising the drive shaft and a tensioner drives the cable through the first housing by providing a gear mesh; as a tensioner knob is unscrewed, an upper flange pulls down on a lever link, driving the tensioner up, pushing the cable into a paddled drive shaft; this deforms the cable to make a matching gear mesh between the cable and the drive shaft allowing the cable to be driven through the first housing.

8. The handheld device of claim 1, wherein the cinch brake assembly further comprises:

a static cam style head cinch plate, mechanically coupled to the first housing a brake lever, attached to a brake shaft that travels through a brake mounting plate;

a cam head pivot cinch arm, attached to the brake shaft;

a cinch torsion spring, attached to the brake shaft; wherein the cinch torsion spring operates to move the brake lever, preventing movement of the cable through the first housing.

* * * * *